US009842728B2

(12) United States Patent
Berkout

(10) Patent No.: US 9,842,728 B2
(45) Date of Patent: Dec. 12, 2017

(54) ION TRANSFER TUBE WITH INTERMITTENT INLET

(71) Applicant: Smiths Detection Inc., Edgewood, MD (US)

(72) Inventor: Vadym Berkout, Rockville, MD (US)

(73) Assignee: Smiths Detection, Edgewood, MD (US)

( * ) Notice: Subject to any disclaimer, the term of this patent is extended or adjusted under 35 U.S.C. 154(b) by 0 days.

(21) Appl. No.: 15/179,330

(22) Filed: Jun. 10, 2016

(65) Prior Publication Data

US 2016/0293392 A1 Oct. 6, 2016

Related U.S. Application Data

(63) Continuation-in-part of application No. 14/906,129, filed as application No. PCT/US2014/045600 on Jul. 7, 2014.

(Continued)

(51) Int. Cl.

*H01J 49/24* (2006.01)
*H01J 49/04* (2006.01)
*H01J 49/00* (2006.01)

(52) U.S. Cl.

CPC ..... *H01J 49/0031* (2013.01); *H01J 49/0404* (2013.01)

(58) Field of Classification Search

CPC .... H01J 49/0422; H01J 49/0495; H01J 49/24; H01J 49/0013; H01J 49/0031; H01J 49/04; H01J 49/10; H01J 49/26; H01J 49/0404; H01J 49/0027; H01J 49/00; H01J 49/165; H01J 49/004; H01J 49/0409; H01J 49/168;

(Continued)

(56) References Cited

U.S. PATENT DOCUMENTS 3,500,040 A 3/1970 Padrta
5,485,016 A * 1/1996 Irie ..... H01J 49/0422 250/281

(Continued)

FOREIGN PATENT DOCUMENTS

JP 6302296 A 2/1991

OTHER PUBLICATIONS

Yamashita, M. et al., "Electrospray Ion Source. Another Variation on the Free-Jet Theme", J. Phys. Chem, 1984, 38, pp. 4451-4459.

(Continued)

*Primary Examiner* — David A Vanore

(74) *Attorney, Agent, or Firm* — Advent, LLP

(57) ABSTRACT

An ion transfer tube assembly, a mass spectrometry system, and a method for providing an ion stream to an ion detection device are described that include using an ion transfer tube and an additional conduit connected to a small high-flow low vacuum pump and a valve. In an implementation, an ion transfer tube assembly includes an ion transfer tube assembly having an intermittent inlet for delivering an ion stream to an ion detection device that employs example techniques in accordance with the present disclosure includes an ion transfer tube, where the ion transfer tube is coupled to a first conduit; a second conduit coupled to the ion transfer tube and the ion detection device; and a third conduit coupled to the second conduit, where the third conduit includes a valve and is coupled to a pump.

20 Claims, 3 Drawing Sheets

Related U.S. Application Data

(60) Provisional application No. 61/856,389, filed on Jul. 19, 2013.

(58) Field of Classification Search
CPC .. H01J 49/005; H01J 49/0431; H01J 49/0445; H01J 49/0459; H01J 49/105; H01J 49/145; H01J 49/40; H01J 49/4205; H01J 49/4215
USPC ..... 250/288, 282, 281, 289, 430, 287, 290, 250/293, 423 R, 425, 433
See application file for complete search history.

(56) References Cited

U.S. PATENT DOCUMENTS 6,518,581 B1 2/2003 Dheandhanoo et al.
8,680,464 B2 * 3/2014 Hashimoto ..... H01J 49/0013 250/282
8,853,627 B2 * 10/2014 Ouyang ..... H01J 49/0495 250/281
8,866,070 B2 * 10/2014 Morokuma ..... H01J 49/0031 250/281
9,006,679 B2 * 4/2015 Morokuma ..... H01J 49/0495 250/282
9,058,967 B2 * 6/2015 Ouyang ..... H01J 49/0495
9,406,492 B1 * 8/2016 Ramsey ..... B01L 3/5027
2008/0116370 A1 5/2008 Splendore et al.
2010/0223979 A1 9/2010 Ploehn et al.
2013/0056633 A1 * 3/2013 Hashimoto ..... H01J 49/0013 250/288
2013/0105683 A1 * 5/2013 Ouyang ..... H01J 49/0495 250/282
2013/0126723 A1 * 5/2013 Ouyang ..... H01J 49/0404 250/282
2013/0146759 A1 * 6/2013 Ouyang ..... H01J 49/0495 250/282
2013/0280819 A1 * 10/2013 Cooks ..... H01J 49/0445 436/173
2014/0138540 A1 * 5/2014 Ouyang ..... H01J 49/0013 250/288
2015/0340218 A1 * 11/2015 Papanastasiou .... H01J 49/0495 250/289
2016/0181079 A1 * 6/2016 Berkout ..... H01J 49/0422 250/282
2016/0293392 A1 * 10/2016 Berkout ..... H01J 49/0031

OTHER PUBLICATIONS

Carroll, D. I. et al., Atmospheric Pressure Ionization Mass Spectrometry: Corona Discharge Ion Source for Use in Liquid Chromatograph-Mass Spectrometer-Computer Analytical System, Analytical Chemistry, vol. 47, No. 14, Dec. 1975, pp. 2369-2373.
Takats, Z. et al., Mass Spectrometry Sampling Under Ambient Conditions with Desorption Electrospray Ionization, Science, vol. 306, Oct. 15, 2004, pp. 471-473.
International Search Report dated Oct. 22, 2014 for PCT/US2014/045600.
Office Action dated Jan. 22, 2017 for Chinese Appln. No. 201480041000.4.
Extended European Search Report dated Feb. 3, 2017 for European Appln. No. 14826637.2.

* cited by examiner

ION TRANSFER TUBE WITH INTERMITTENT INLET

CROSS REFERENCE TO RELATED APPLICATIONS

The present patent application claims the benefit of and priority to U.S. Provisional Application Ser. No. 61/856,389, filed Jul. 19, 2013, entitled "Mass Spectrometer Inlet with Reduced Average Flow," and International Application PCT/US2014/045600, filed on Jul. 7, 2014, entitled "Mass Spectrometer Inlet with Reduced Average Flow", which are assigned to the assignee of the present patent application, and which are hereby incorporated herein by reference in their entireties.

BACKGROUND

The present disclosure relates to mass spectrometry and more particularly to remote ionization and ion transfer.

Mass spectrometers (MS) operate in a vacuum and separate ions with respect to mass-to-charge ratio. In embodiments that use a mass spectrometer, a sample, which may be solid, liquid, or gas, is ionized. The ions are separated in a mass analyzer according to mass-to-charge ratio and are detected by a device capable of detecting charged particles. The signal from the detector is then processed into the spectra of the relative abundance of ions as a function of the mass-to-charge ratio. The molecules are identified by correlating the identified masses with known masses or through a characteristic fragmentation pattern.

SUMMARY

An ambient ionization source, an ion transfer tube assembly, a mass spectrometry system, and a method for providing an ion stream to a mass spectrometry system are described that include using an ion transfer tube, a junction at a mass spectrometer inlet, and a high-flow small pump with a valve used to create a large ion stream flow in the ion transfer tube and then directing a portion of the ion stream (an "ion plug") into the mass spectrometer inlet. In an implementation, an ion transfer tube assembly having an intermittent inlet for delivering an ion stream to an ion detection device that employs example techniques in accordance with the present disclosure includes an ion transfer tube that transports the ion stream, where the ion transfer tube is coupled to a first conduit coupled to an ion source; a second conduit coupled to the ion transfer tube and the ion detection device, where the second conduit transports the ion stream from the ion transfer tube to the ion detection device; and a third conduit coupled to the second conduit, where the third conduit includes a valve and is coupled to a pump, where a first ion stream flow in the ion transfer tube results when the valve is open, where a second ion stream flow in the ion transfer tube results when the valve is closed, where the second ion stream flow is less than the first ion stream flow, and where a portion of the first ion stream flow is directed to an ion detection device while the valve is closed.

In an implementation, a mass spectrometry system that employs example techniques in accordance with the present disclosure includes an ambient ionization ion source coupled to a first conduit; an ion transfer tube that transports an ion stream, where the ion transfer tube is coupled to the first conduit; an ion detection device coupled to a second conduit, where the second conduit is coupled to the ion transfer tube, where the second conduit transports the ion stream from the ion transfer tube to the ion detection device; a third conduit coupled to the second conduit, where the third conduit includes a valve and is coupled to a pump, where a first ion stream flow rate is created when the valve is open, and where a portion of the first ion stream flow rate is directed to the mass spectrometer inlet when the valve is closed, and where the second ion stream flow rate is less than the first ion stream flow rate; and a pump fluidly coupled to the third conduit.

In an implementation, a method for providing an ion stream to a mass spectrometry system that employs example techniques in accordance with the present disclosure includes providing the ion stream using an ion source having a first conduit; providing the ion stream from the ion source and the first conduit through an ion transfer tube to an ion detection device having a second conduit, where the second conduit is fluidly coupled to a third conduit at a junction, and where the third conduit includes a valve and is fluidly coupled to a pump; opening the valve when the ion detection device is analyzing an ion sample to create a first ion stream flow rate; and closing the valve to direct a portion of the first ion stream to the mass spectrometer inlet during ion injection into the ion detection device, where closing the valve causes a second ion stream flow rate that is less than the first ion stream flow rate.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. The use of the same reference number in different instances in the description and the figures may indicate similar or identical items.

DETAILED DESCRIPTION

Overview

Figure 1:
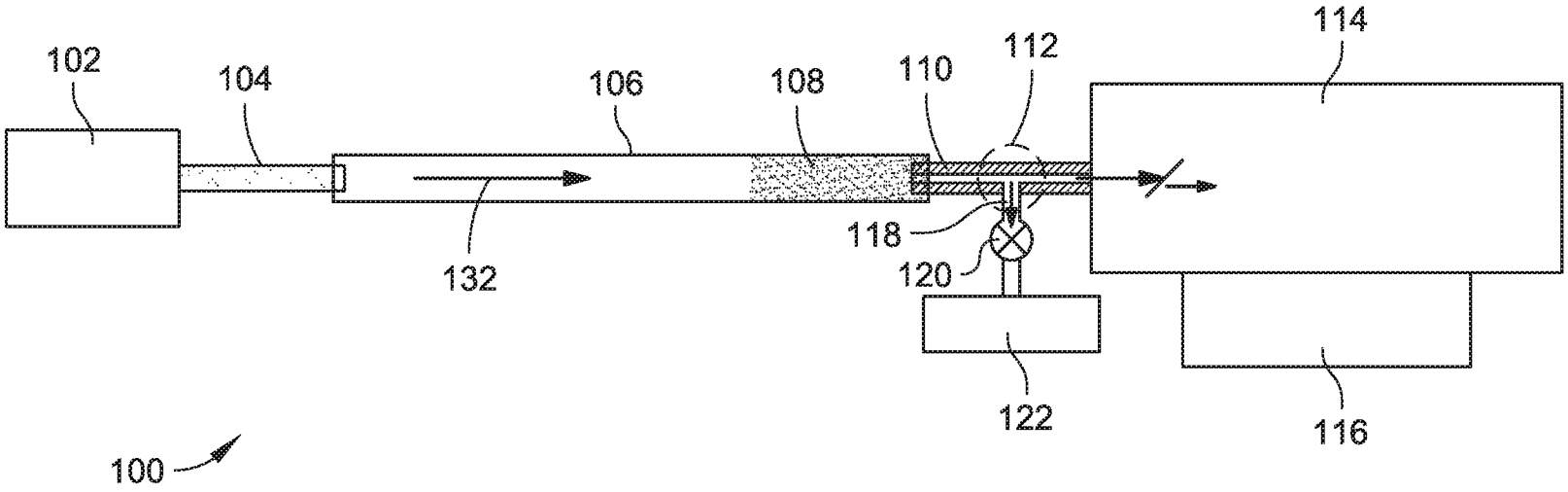
FIG. 1 is a diagrammatic cross-sectional view illustrating an analysis system including an ion transfer tube and a valve in accordance with an example implementation of the present disclosure.

Mass spectrometers (MS) operate in a vacuum and separate ions with respect to the mass-to-charge ratio. In some embodiments using a mass spectrometer, a sample, which may be solid, liquid, or gas, is ionized and analyzed. The ions are separated in a mass analyzer according to mass-to-charge ratio and are detected by a detector capable of detecting charged particles. The signal from the detector is then processed into the spectra of the relative abundance of ions as a function of the mass-to-charge ratio. The molecules are identified by correlating the identified masses with known masses or through a characteristic fragmentation pattern.

Ambient ionization methods can be used in an MS or ion-mobility spectrometry (IMS) system to ionize substances for real-time and in situ chemical analysis without any sample preparation. Among them are desorption electrospray ionization (DESI), direct analysis in real-time (DART), low-temperature plasma (LTP), direct atmospheric pressure chemical ionization (DAPCI) and many others. However, the application of ambient ionization for real-life problems is limited by the shortness of the distance from the sample to inlet of ion detection device. Remote sample ionization involves ion transfer to the detection system inlet using flexible tubing. However, ions from the substance which will be analyzed are frequently generated at higher pressure conditions, for example, at atmospheric pressure. A variety of direct ambient ionization methods include desorption electrospray ionization (DESI) (Takats, Z.; Wiseman, J. M.; Gologan, B.; Cooks, R. G. Science 2004, 306, 471-473), direct analysis in real time (DART) (Cody, R. B.; Laramee, J. A.; Durst, H. D. Anal. Chem. 2005, 77, 2297-2302), atmospheric pressure Dielectric Barrier Discharge Ionization (DBDI) (Na, N.; Zhao, M.; Zhang, S.; Yang, C.; Zhang, X., J Am Soc Mass Spectrom 2007, 18, 1859-1862), low-temperature plasma (LTP) (Harper, J. D.; Charipar, N. A.; Mulligan, C. C.; Zhang, X.; Cooks, R. G.; Ouyang, Z., Anal. Chem. 2008, 80, 9097-9104), etc.

In many instances it is not feasible to place analyzed samples in front of a mass spectrometer inlet. In this case generated ions needs to be transferred over the long distance without significant loss of analyte signal.

There are significant technical challenges for providing efficient transfer of low abundance analyte ions of interest from an ionization source into ion detection system over a long distance, especially in the case of a miniature mass analyzer. The challenges are mainly related to size and weight limitations of portable systems, which severely limit the choice of vacuum pumps that can be used in such systems. Small vacuum pumps limit the intake flows into a mass spectrometer to about 0.15 L/min. The main mechanism of ion losses in long narrow tubing at ion concentrations less than $10^8$ $cm^{-3}$ is radial diffusion to the walls (Lin, B.; Sunner, J., Ion transport by viscous gas flow through capillaries, *J Am Soc Mass Spectrom,* 1994, 5, 873-885). The change in ion concentration n with diffusion limited losses can be described by:

$$n/n_0 = \exp\left(-\frac{D^* t}{r_0^2} 2.405^2\right) \quad \text{Equation 1}$$

where D*=D/1.6 is an effective ion diffusion coefficient (to account for parabolic velocity profile inside the capillary) and t is residence time (Sunner, J. et al.). The total residence time $t_f$ can be calculated from the value of the intake flow C and the capillary volume V:

$$t_f = \frac{60\ \mathrm{V}}{Q} \quad \text{Equation 2}$$

where factor 60 is coming from conversion of L/min to L/s. Substituting $t_f$ in equation 1 and using the relation $V=\pi r_0^2 L$ one can obtain:

$$n/n_0 = \exp\left(-\frac{0.68\ \mathrm{LD}}{Q}\right) \quad \text{Equation 3}$$

where Q is the intake flow in L/min and L is the capillary length in cm. However, as can be calculated from these equations, for a portable mass spectrometer (e.g., Q~0.15 L/min) with remote sampling at L=50 cm and a typical value for a diffusion coefficient of D=0.04 $cm^2/s$, only 0.01% of ions are transmitted from the ionization source to the mass analyzer.

One way to overcome this problem for remote direct ionization was proposed by R. Graham Cooks et al., in U.S. Pat. No. 8,592,756, which is incorporated herein by reference, where a gas flow, created by an additional pump at the inlet of a mass spectrometer, pulls ions produced by LTP ionization into a transfer tube with a much higher flow rate than intake flow into the MS inlet. This arrangement allows to reduce diffusion ion losses on walls of the ion transfer tube because of decreased ion residence time. However, in the Cooks et al. arrangement, ions are distributed over the whole internal area of large diameter tube (e.g., 6.0 mm is shown on FIG. 17 of U.S. Pat. No. 8,592,756), which is much bigger than a diameter of mass spectrometer inlet (e.g., 0.25 mm according to Gao et al. Anal. Chem., 2008, 80, 4026-4032) (paragraph 40 of column 11, U.S. Pat. No. 8,592,756). As the ion flow is proportional to a cross-section area, the portion of ions going to the mass spectrometer inlet is about 0.02% (~$(0.25/6.0)^2$) and the rest are swept away by the additional pump, thus significantly reducing the sensitivity of detection.

Accordingly, an ion transfer tube assembly, a mass spectrometry system, and a method for providing an ion stream to a mass spectrometry system are described that include using an ion transfer tube and an additional conduit connected to a small high-flow low vacuum pump, where a valve is used to create a large ion stream flow or a small gas flow in the ion transfer tube. In an implementation, an ion transfer tube assembly having an intermittent inlet for delivering an ion stream to an ion detection device that employs example techniques in accordance with the present disclosure includes an ion transfer tube that transports the ion stream, where the ion transfer tube is coupled to a first conduit coupled to an ion source; a second conduit coupled to the ion transfer tube and the ion detection device, where the second conduit transports the ion stream from the ion transfer tube to the ion detection device; and a third conduit coupled to the second conduit, where the third conduit includes a valve and is coupled to a pump, and where a first ion stream flow rate is created when the valve is open, and where a second ion stream flow rate is created when the valve is closed to direct a portion of the first ion stream to the mass spectrometer inlet, where the second ion stream flow rate is less than the first ion stream flow rate.

In an implementation, a mass spectrometry system that employs example techniques in accordance with the present disclosure includes an ion source coupled to a first conduit; an ion transfer tube that transports an ion stream, where the ion transfer tube is coupled to the first conduit; an ion detection device coupled to a second conduit, where the second conduit is coupled to the ion transfer tube, where the second conduit transports the ion stream from the ion transfer tube to the ion detection device; a third conduit coupled to the second conduit, where the third conduit includes a valve and is coupled to a pump, where a first ion stream flow rate is created when the valve is open, and where a second ion stream flow rate is created when the valve is closed to direct a portion of the first ion stream to the mass spectrometer inlet, and where the second ion stream flow rate is less than the first ion stream flow rate; and a pump fluidly coupled to the third conduit.

In an implementation, a method for providing an ion stream to a mass spectrometry system that employs example techniques in accordance with the present disclosure includes providing the ion stream using an ion source having a first conduit; providing the ion stream from the ion source and the first conduit through an ion transfer tube to an ion detection device having a second conduit, where the second conduit is fluidly coupled to a third conduit at a junction, and where the third conduit includes a valve and is fluidly coupled to a pump; opening the valve when the ion detection device is analyzing an ion sample to create a first ion stream flow rate; and closing the valve to direct a portion of the first ion stream to the mass spectrometer inlet during ion injection into the ion detection device, where closing the valve causes a second ion stream flow rate that is less than the first ion stream flow rate.

In the above implementations, the ions can be prevented from loss on the walls of an ion transfer tube by varying high and low flows through the ion transfer tube by intermittently opening or closing the valve. During a mass analysis portion of the system cycle, the valve can be opened and a small low compression pump creates a large ion stream flow through the ion transfer tube, a portion of the second conduit, and the third conduit. When the flow Q is large, ion loss due to diffusion are minimized according to Equation 3 above. When the valve is closed (e.g., during ion injection into the ion detection device and/or mass spectrometer), the flow Q is small and determined by a mass spectrometer vacuum pump. A small flow will provide an ion plug with a high ion concentration (because ions were brought to this portion of ion transfer tube by high flow), which will be drawn inside the ion detection device (e.g., mass spectrometer) through the second conduit (e.g., a small length of capillary tubing), thus minimizing ion losses.

Example Implementations

Figure 2:
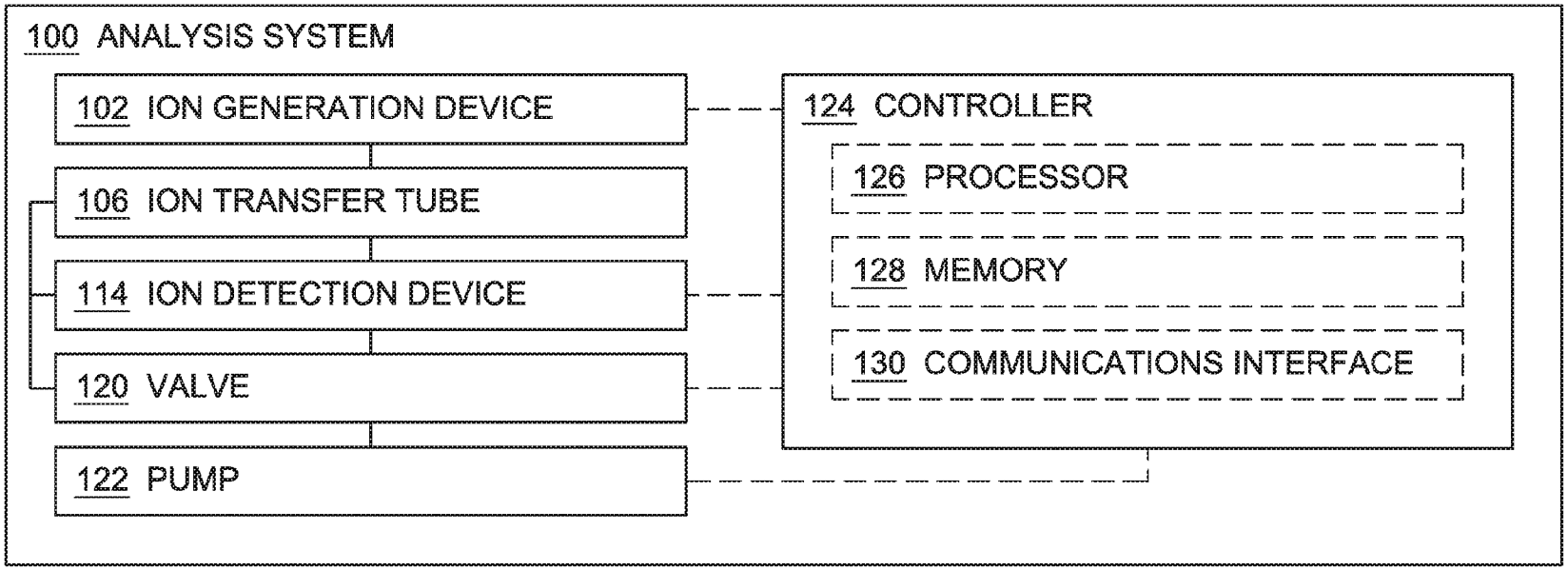
FIG. 2 is a block diagram illustrating an analysis system including an ion transfer tube and a valve in accordance with an example implementation of the present disclosure.

FIGS. 1 and 2 illustrate an analysis system 100 (e.g., mass spectrometry system) and an ion transfer tube 106 (e.g., ion transfer tube assembly) in accordance with example implementations of the present disclosure. As shown, the analysis system 100 can include an ion source 102, a first conduit 104, an ion transfer tube 106, a second conduit 110, an ion detection device 114, and a third conduit 118 with a valve 120.

In implementations, the analysis system 100 can include an ion source 102 that provides an ion stream 132 to the ion detection device 114 for analysis. The ion source 102 can receive a substance (e.g., fluid, solid, etc.) and use the substance to produce ions that are indicative of the composition of the substance to be analyzed. Some examples of an ion source 102 may include an electrospray ion source, a sonic spray ionization source, atmospheric pressure matrix-assisted laser desorption/ionization, nano-electrospray ionization, atmospheric pressure chemical ionization, desorption electrospray ionization (DESI), direct analysis in real-time (DART), direct atmospheric pressure chemical ionization (DAPCI), dielectric barrier discharge ionization, low-temperature plasma desorption ionization, and electrospray-assisted laser desorption ionization, an inductively-coupled plasma, a spark ion source, a corona discharge ion source, a radioactive ion source (e.g., $^{63}$Ni or $^{241}$Am), etc. In embodiments, the ion source 102 may generate ions from an object of interest at atmospheric pressure or other pressures (e.g., a reduced pressure, high pressure, etc.).

As shown in FIGS. 1 and 2, the ion source 102 can be coupled to an ion transfer tube 106 so that an ion stream 132 (e.g., ion beam, gas stream with ions, etc.), which can include ions created and/or provided by the ion source 102 and carried by a gas (e.g., air), can travel through a first conduit 104. In some embodiments, the first conduit 104 may include a capillary tube. In one specific embodiment, the first conduit 104 includes a heated capillary tube. In another specific embodiment, the first conduit 104 included a non-heated capillary tube. In some instances, the first conduit 104 may have a constant diameter (e.g., a planar plate or cylinder) and/or a disparate diameter (e.g., a capillary with an inlet that is larger than the outlet). In the implementation shown in FIG. 1, the first conduit 104 can extend from the ion source 102 and into the ion transfer tube 106 such that the ion stream 132 exits a first conduit outlet 130 into the ion transfer tube 106. In one specific implementation, the first conduit outlet 130 can be disposed in the center of the cross-section of the ion transfer tube 106. In a specific embodiment, the first conduit 104 can have a diameter between 0.25 mm and 1.50 mm. It is contemplated that the first conduit 104 may have other diameter sizes and/or configurations (e.g., 0.15 mm, 3.5 mm, etc.). Additionally, the ion source 102 may include a remote ion source 102 in some instances with varying distances between the ion source 102 and the ion detection device 114 (e.g., two meters, 50 meters, etc.).

The ion transfer tube 106 can be configured to deliver ions from an object of interest in an ion stream 132 from the ion source 102 to an ion detection device 114, which can include a mass spectrometer inlet, with an intermittent flow rate. In some embodiments, the ion transfer tube 106 may include a generally cylindrical and/or flexible tube configured to contain a gas flow, such as a polymer flow tube. In some embodiments, the ion transfer tube 106 may include other materials suitable for a gas flow, such as glass or metal, and may be conductive or non-conductive.

FIGS. 1 and 2 illustrate an ion detection device 114 configured to receive an ion sample from ion stream 132 by way of a second conduit 110. The second conduit 110 may be disposed in and/or coupled to the ion transfer tube 106 and exposed to the ion stream 132 and/or ion plug 108 (caused by a low gas flow rate). The ions from the ion stream 132 can then continue through the second conduit 110 to the ion detection device 114. In one specific implementation, the second conduit 110 may include a diameter of about 0.5 mm. It is contemplated that the second conduit inlet 132 may include other diameters and/or configurations (e.g., 0.25 mm, 0.6 mm, cylindrical, differing diameters, a constant diameter, etc.).

Additionally, a third conduit 118 can be coupled to the second conduit 110 at a junction 112. The third conduit 118 may include materials such as a polymer, metal, and/or glass. In implementations, the third conduit 118 can include a valve 120 and can be fluidly coupled to a pump 122. The valve 120 may be intermittently opened and closed to form a large gas flow rate and a small gas flow rate, respectively, through the ion transfer tube 106. Some examples of a valve 120 may include a ball valve and/or a needle valve. Additionally, the valve may include an actuator (e.g., electric, pneumatic, etc.). In these implementations, the third conduit 118 can be configured to facilitate a first gas flow (e.g., 2.0 L/min, 1.0 L/min, etc.) that is higher than a second gas flow (e.g., 0.15 L/min), which the second conduit 110 may be configured to facilitate. The valve 120 can be communicably coupled to a controller 124, which may control the position (e.g., open, shut, partially shut, etc.) of the valve 120.

As illustrated in FIGS. 1 and 2, a pump 122 can be in fluid communication with the ion transfer tube 106, the second conduit 110, and/or the third conduit 118. In implementations, the pump 122 can be configured to pump the gas flow (e.g., air, a carrier gas, etc.) and ion stream 132 through the ion transfer tube 106, a portion of the second conduit 110, and/or the third conduit 118. Some examples of the pump 122 can include a scroll pump, a diaphragm pump, a compressor, or any pump suitable to provide a gas flow through the ion transfer tube 106 and/or the third conduit 118. The pump 122 may be configured to provide a high gas flow (e.g., 1.0 L/min) through the ion transfer tube 106 and/or the third conduit 118 in instances that the valve 120 is in an open position. In some embodiments, the pump 122 may include a vent and/or other means for venting the gas flow through the third conduit 118. In one specific implementation, the pump 122 can include a vacuum pump configured to pump the ion stream 132 and gas flow from the third conduit 118 and to vent the gas stream into the atmosphere. The pump 122 can be coupled to a controller 124, which can control the pump 122.

In implementations, the ion detection device 114 can include a mass spectrometer that separates ionized masses based on charge to mass ratios and outputs the ionized masses to a detector. Some examples of an ion detection device 114 and/or mass spectrometer include a quadrupole mass analyzer, a time of flight (TOF) mass analyzer, a magnetic sector mass analyzer, an electrostatic sector mass analyzer, a quadrupole ion trap mass analyzer, etc. Some examples of a detector that can be used in the ion detection device 114 and/or mass spectrometer can include an electron multiplier, Faraday cups, and/or ion-to-photon detectors.

Additionally, pump 116 can be coupled to the ion detection device 114 as illustrated in FIG. 1. In implementations, pump 116 can include a high vacuum pump. A vacuum, at least partially created by a high vacuum pump, such as pump 116, can reduce and/or eliminate ion-molecule collisions within the ion detection device 114 that may otherwise reduce the effectiveness of the mass spectrometer at separating elements based on their mass-to-charge ratios because molecular collisions may significantly alter the trajectories of the molecules or ions involved and result in less ions of a desired mass/charge reaching the detector of the mass spectrometer. In instances when the valve 120 is in a closed configuration and the ion detection device 114 is in an ion injection cycle/mode, the pump 116 can create a vacuum that can draw in an ion sample (e.g., 0.2 L/min) from an ion plug 108 disposed in the ion transfer tube 106 and/or the second conduit 110. In embodiments, the pump 116 can be coupled to a vacuum chamber of the ion detection device 114 that requires a high vacuum (e.g., low pressure). For example, the pump 116 may be coupled to a vacuum chamber of the ion detection device 114 (e.g., requiring approximately $10^{-3}$ Torr). In some specific implementations, the pump 116 may include, for example, a turbomolecular vacuum pump.

The analysis system 100 and third conduit 118 with the valve 120 can be configured to provide an intermittent gas flow that minimize and/or prevent ion losses to walls of the ion transfer tube 106, especially over long distances (e.g., of tubing). During the mass analysis portion of the analysis system 100 cycle, controller 124 can open the valve 120 and pump 122 can create a large gas flow (e.g., 1.0 L/min) through the ion transfer tube 106, the second conduit 110, junction 112, and third conduit 118. When the gas flow is large, ion losses due to diffusion to the walls of the ion transfer tube 106 are minimized. During ion injection into the ion detection device 114, controller 124 can close (or partially close) valve 120, which creates a small gas flow (e.g., less than the large gas flow described above, 0.2 L/min) through the ion transfer tube 106 and the second conduit 110. In this instance, the small gas flow does not travel through the third conduit 118 and/or the valve 120. When the gas flow is small, the gas flow is determined by the ion detection device 114 and/or the pump 116. The small gas flow transfers only a small portion of ion stream from ion transfer tube 106, referred to as an ion plug 108 with a high ion concentration, that is proximate to the portion of the ion transfer tube 106 coupled to the second conduit 110 because of the ions brought by the large flow. Subsequent to ion injection by the ion detection device 114, controller 124 can open the valve 120 to create a high gas flow which move the ions from ion source 102 without significant losses through ion transfer tube 106 to junction 112. The intermittent gas flow created by cycling the large gas flow and the small gas flow previously described prevents ion losses to the walls of the ion transfer tube 106, especially in the case of a remote ion source 102 and/or large distances between the components of the analysis system 100.

Referring to FIG. 2, the analysis system 100, including some or all components, can operate under computer control. For example, a processor 126 can be included with or in the analysis system 100 and/or controller 124 to control the components and functions of the analysis system 100 described herein using software, firmware, hardware (e.g., fixed logic circuitry), manual processing, or a combination thereof. The terms "controller," "functionality," "service," and "logic" as used herein generally represent software, firmware, hardware, or a combination of software, firmware, or hardware in conjunction with controlling the analysis system 100. In the case of a software implementation, the module, functionality, or logic represents program code that performs specified tasks when executed on a processor (e.g., central processing unit (CPU) or CPUs). The program code can be stored in one or more computer-readable memory devices (e.g., internal memory and/or one or more tangible media), and so on. The structures, functions, approaches, and techniques described herein can be implemented on a variety of commercial computing platforms having a variety of processors.

Illustrated in FIG. 2, the analysis system 100 can be coupled with a controller 124 for controlling the analysis system 100. The controller 124 can include a processor 126, a memory 128, and a communications interface 130. In some embodiments, the controller 124 may be integrated into and/or include an integrated circuit (IC) with a user interface (e.g., controls, a readout, etc.) for the analysis system 100. In other embodiment, the controller 124, processor 126, memory 128, communications interface 130, and/or user interface may be integrated into one system-in-package/module and/or one or more could be separate discrete components in an end system (e.g., analysis system 100).

The processor 126 provides processing functionality for the analysis system 100 and/or controller 124 and can include any number of processors, micro-controllers, or other processing systems, and resident or external memory for storing data and other information accessed or generated by the analysis system 100 and/or controller 124. The processor 126 can execute one or more software programs that implement techniques described herein. The processor 126 is not limited by the materials from which it is formed or the processing mechanisms employed therein and, as such, can be implemented via semiconductor(s) and/or transistors (e.g., using electronic integrated circuit (IC) components), and so forth.

The controller 124 may include a memory 128. The memory 128 can be an example of tangible, computer-readable storage medium that provides storage functionality to store various data associated with operation of the analysis system 100 and/or controller 124, such as software programs and/or code segments, or other data to instruct the processor 126, and possibly other components of the analysis system 100 and/or controller 124, to perform the functionality described herein. Thus, the memory 128 can store data, such as a program of instructions for operating the analysis system 100 (including its components), and so forth. It should be noted that while a single memory 128 is described, a wide variety of types and combinations of memory (e.g., tangible, non-transitory memory) can be employed. The memory 128 can be integral with the processor 126, can comprise stand-alone memory, or can be a combination of both. In specific instances, the memory 128 may include a buffer (e.g., a region of a physical memory storage used to temporarily store data while it is being moved from one place to another) and/or datalog for storing sensor data.

The memory 128 can include, but is not necessarily limited to removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, and so forth. In implementations, the analysis system 100 and/or the memory 128 can include removable integrated circuit card (ICC) memory, such as memory provided by a subscriber identity module (SIM) card, a universal subscriber identity module (USIM) card, a universal integrated circuit card (UICC), and so on.

The controller 124 may include a communications interface 130. The communications interface 130 can be operatively configured to communicate with components of the analysis system 100. For example, the communications interface 130 can be configured to transmit data for storage in the analysis system 100, retrieve data from storage in the analysis system 100, and so forth. The communications interface 130 can also be communicatively coupled with the processor 126 to facilitate data transfer between components of the analysis system 100 and the processor 126 (e.g., for communicating inputs to the processor 126 received from a device communicatively coupled with the analysis system 100 and/or controller 124). It should be noted that while the communications interface 130 is described as a component of an analysis system 100 and/or controller 124, one or more components of the communications interface 130 can be implemented as external components communicatively coupled to the analysis system 100 via a wired and/or wireless connection. The analysis system 100 can also include and/or connect to one or more input/output (I/O) devices (e.g., via the communications interface 130), including, but not necessarily limited to a display, a mouse, a touchpad, a keyboard, and so on.

The communications interface 130 and/or the processor 126 can be configured to communicate with a variety of different networks, including, but not necessarily limited to a wide-area cellular telephone network, such as a 3G cellular network, a 4G cellular network, or a global system for mobile communications (GSM) network; a wireless computer communications network, such as a WiFi network (e.g., a wireless local area network (WLAN) operated using IEEE 802.11 network standards); an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example only and is not meant to limit the present disclosure. Further, the communications interface 130 can be configured to communicate with a single network or multiple networks across different access points.

Generally, any of the functions described herein can be implemented using hardware (e.g., fixed logic circuitry such as integrated circuits), software, firmware, manual processing, and/or a combination thereof. Thus, the blocks discussed in this disclosure generally represent hardware (e.g., fixed logic circuitry such as integrated circuits), software, firmware, or a combination thereof. In the instance of a hardware configuration, the various blocks discussed in the above disclosure may be implemented as integrated circuits along with other functionality. Such integrated circuits may include all of the functions of a given block, system, or circuit, or a portion of the functions of the block, system, or circuit. Further, elements of the blocks, systems, or circuits may be implemented across multiple integrated circuits. Such integrated circuits may comprise various integrated circuits, including, but not necessarily limited to a monolithic integrated circuit, a flip chip integrated circuit, a multichip module integrated circuit, and/or a mixed signal integrated circuit. In the instance of a software implementation, the various blocks discussed in the above disclosure represent executable instructions (e.g., program code) that perform specified tasks when executed on a processor. These executable instructions can be stored in one or more tangible computer readable media. In some such instances, the entire system, block, or circuit may be implemented using its software or firmware equivalent. In other instances, one part of a given system, block, or circuit may be implemented in software or firmware, while other parts are implemented in hardware. In a specific embodiment, an analysis function or other parts and functions of the analysis system 100 can be implemented on a remote system (e.g., a server).

Further, the analysis system 100 may include a user interface. In implementations, a user interface can include a device configured to display information to a user. For example, a user interface can include a display screen and/or a touch screen. In one specific embodiment, analysis system 100 includes a user interface that further includes a touch screen that is coupled to controller 124 and is configured to present sensor information to a user. In this specific embodiment, the user interface may also receive input from a user and transmit the input to controller 124.

Example Processes

Figure 3:
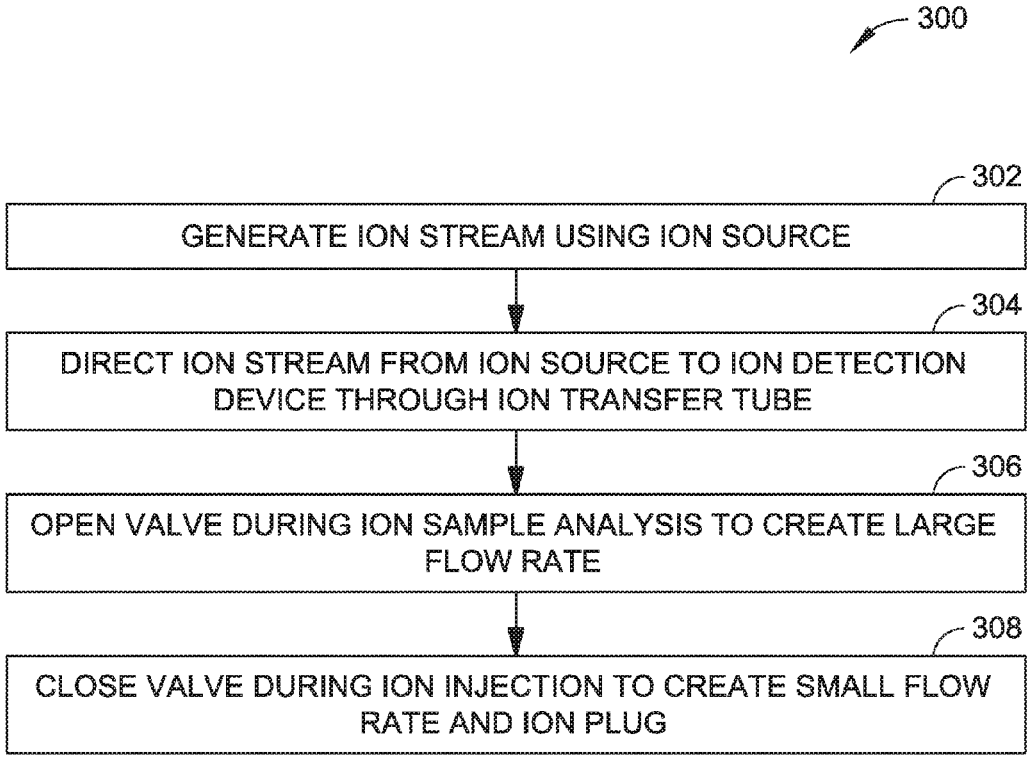
FIG. 3 is a flow diagram illustrating an example process for utilizing the analysis system including the ion transfer tube and valve illustrated in FIGS. 1 and 2.

FIG. 3 illustrates an example process 300 that employs the disclosed techniques to employ an analysis system with an intermittent flow and/or a mass spectrometer, such as the analysis system 100 and ion detection device 114 shown in FIGS. 1 and 2.

Accordingly, an ion stream is provided using an ion source (Block 302). In implementations, producing an ion stream 132 including a sample of ions from an object of interest can include, for example, using an ion source 102 (e.g., electrospray ionization, inductively-coupled plasma, spark ionization, a corona source, low-temperature plasma ionization, a radioactive source (e.g., 63Ni), etc.) to produce ions, which are subsequently introduced into first conduit 104 and/or ion transfer tube 106 with a gas flow (e.g., air, a carrier gas, etc.). In one embodiment, producing a sample of ions includes using an ion source 102 including an electrode and a low-temperature plasma ionization process. In another embodiment, providing an ion stream 132 can include using a corona discharge ion source 102 that utilizes a corona discharge surrounding a conductor to produce the sample of ions from the object of interest. In another embodiment, providing an ion stream can include using electrospray ionization to produce the sample of ions. Electrospray ionization may include applying a high voltage to a sample through an electrospray needle, which emits the sample in the form of an aerosol. The aerosol then traverses the space between the electrospray needle and a cone while solvent evaporation occurs, which results in the formation of ions. It is contemplated that providing an ion stream 132 may include using other types of an ion source 102.

The ion stream is provided to an ion detection device using an ion transfer tube (Block 304). In implementations, providing an ion stream 132 can include using a gas flow created by a pump 116 when valve 120 is closed or by a pump 122 when valve 120 is open (or partially open) to deliver the ion stream 132 to the ion detection device 114. The sample of ions and/or the ion stream 132 can travel and/or move through the first conduit 104, the ion transfer tube 106, and the second conduit 110 to the ion detection device 114. In a specific embodiment, pump 116 can create a gas flow of 0.20 L/min that provides ion stream 132 to the second conduit 110 and ion detection device 114.

A valve is opened to create a first ion stream flow rate during ion sample analysis (Block 306). In implementations, a controller 124 can open valve 120, and pump 122 can create a large gas flow (e.g., 1.0 L/min) and ion stream 132 through the ion transfer tube 106, a portion of the second conduit 110, junction 112, and the third conduit 118. Because the valve 120 is open, the gas flow and the ion stream 132 flow at a large flow rate through the third conduit 118 to the pump 122. The pump 122 can vent the ion stream 132 and gas flow to the atmosphere. The valve 120 can be opened when the ion detection device 114 is analyzing a previously injected sample of ions so the ion detection device 114 doesn't accept ions from outside at this state. A second ion stream flow in the ion transfer tube results when the valve is closed, which is less than the first ion stream flow.

The valve is closed to direct a portion of the first ion stream (with high ion concentration) into the ion detection device (Block 304). In implementations, controller 124 can close valve 120 when the ion detection device 114 requires an ion sample injection. In this implementation, the gas flow to the third conduit 118 can be stopped by closing the valve 120, and an ion plug 108 can be formed in the portion of the ion transfer tube 106 proximate to the second conduit 110. A small gas flow (e.g., 0.2 L/min) with an ion sample from the ion plug 108 can be drawn into the ion detection device 114 using pump 116. Using an intermittent gas flow (e.g., alternating between a large flow and a small flow) prevents and/or minimizes ion losses to the walls of the ion transfer tube 106 and/or other components of the analysis system 100. Additionally, the intermittent gas flow provides a high concentration of ions in the ion plug 108, which provide for more accurate and sensitive detection of the ions from the object of interest.

Although the invention has been described in language specific to structural features and/or methodological acts, it is to be understood that the invention defined in the appended claims is not necessarily limited to the specific features or acts described. Although various configurations are discussed the apparatus, systems, subsystems, components and so forth can be constructed in a variety of ways without departing from this disclosure. Rather, the specific features and acts are disclosed as example forms of implementing the claimed invention.

What is claimed is:

1. An ion transfer tube assembly having an intermittent inlet for delivering an ion stream to an ion detection device, comprising:

an ion transfer tube that transports the ion stream, where the ion transfer tube is coupled to a first conduit coupled to an ion source;

a second conduit coupled to the ion transfer tube and the ion detection device, where the second conduit transports the ion stream from the ion transfer tube to the ion detection device; and a third conduit coupled to the second conduit, where the third conduit includes a valve and is coupled to a pump, where a first ion stream flow in the ion transfer tube results when the valve is open, where a second ion stream flow in the ion transfer tube results when the valve is closed, where the second ion stream flow is less than the first ion stream flow, and where a portion of the first ion stream flow is directed to an ion detection device while the valve is closed.

2. The ion transfer tube assembly in claim 1, where the ion source include at least one of a desorption electrospray ionization (DESI), a direct analysis in real-time (DART) ionization, a low-temperature plasma (LTP) ionization, or a direct atmospheric pressure chemical ionization (DAPCI).

3. The ion transfer tube assembly in claim 1, where at least one of the first conduit, the second conduit, or the third conduit include a capillary.

4. The ion transfer tube assembly in claim 1, where the capillary includes a heated capillary.

5. The ion transfer tube assembly in claim 1, where the ion transfer tube includes a conductive polymer.

6. The ion transfer tube assembly in claim 1, where the ion detection device includes a mass spectrometer.

7. The ion transfer tube assembly in claim 1, where the pump includes at least one of a high flow pump or a compressor.

8. A mass spectrometry system, comprising:

an ion source coupled to a first conduit;

an ion transfer tube that transports an ion stream, where the ion transfer tube is coupled to the first conduit;

an ion detection device coupled to a second conduit, where the second conduit is coupled to the ion transfer tube, where the second conduit transports the ion stream from the ion transfer tube to the ion detection device;

a third conduit coupled to the second conduit, where the third conduit includes a valve and is coupled to a pump, where a first ion stream flow rate results when the valve is open and a portion of the ion stream is directed to the ion detection device, where a second ion stream flow rate results when the valve is closed, and where the second ion stream flow rate is less than the first ion stream flow rate; and a pump fluidly coupled to the third conduit.

9. The mass spectrometry system in claim 8, where the ion source include at least one of a desorption electrospray ionization (DESI), a direct analysis in real-time (DART) ionization, a low-temperature plasma (LTP) ionization, or an atmospheric pressure chemical ionization (DAPCI).

10. The mass spectrometry system in claim 8, where at least one of the first conduit or the second conduit include a capillary.

11. The mass spectrometry system in claim 10, where the capillary includes a heated capillary.

12. The mass spectrometry system in claim 8, where the ion transfer tube includes a conductive polymer.

13. The mass spectrometry system in claim 8, where the ion transfer tube is flexible.

14. The mass spectrometry system in claim 8, where the ion detection device includes a mass spectrometer.

15. The mass spectrometry system in claim 8, where the pump includes at least one of a high flow pump or a compressor.

16. The mass spectrometry system in claim 8, further comprising:

a controller coupled to at least one of the ion source or the ion detection device.

17. A method for providing an ion stream to a mass spectrometry system, comprising:

providing the ion stream using an ion source having a first conduit;

providing the ion stream from the ion source and the first conduit through an ion transfer tube to an ion detection device having a second conduit, where the second conduit is fluidly coupled to a third conduit at a junction, and where the third conduit includes a valve and is fluidly coupled to a pump;

opening the valve when the ion detection device is analyzing an ion sample resulting in a first ion stream flow rate; and closing the valve to create an ion plug in the ion transfer tube during ion injection into the ion detection device, where closing the valve causes a second ion stream flow rate that is less than the first ion stream flow rate.

18. The method for delivering an ion stream to a mass spectrometry system in claim 17, where the ion transfer tube includes a conductive polymer.

19. The method for delivering an ion stream to a mass spectrometry system in claim 17, where the ion stream travels from the ion transfer tube through the second conduit and the third conduit to a vent when the valve is open.

20. The method for delivering an ion stream to a mass spectrometry system in claim 17, where the ion stream and the ion plug travels from the ion transfer tube through the second conduit and into the ion detection device when the valve is closed.

* * * * *